US006295665B1

(12) United States Patent
Domenig

(10) Patent No.: US 6,295,665 B1
(45) Date of Patent: Oct. 2, 2001

(54) SINK DRAIN EXTENSION

(76) Inventor: Caroline Domenig, 11110 Whispering Pines, Kernersville, NC (US) 27284

( * ) Notice: Subject to any disclaimer, the term of this patent is extended or adjusted under 35 U.S.C. 154(b) by 0 days.

(21) Appl. No.: 09/528,876

(22) Filed: Mar. 20, 2000

(51) Int. Cl.[7] ..... E03C 1/244
(52) U.S. Cl. ..... 4/686; 4/687
(58) Field of Search ..... 4/686, 687, 679, 4/286, 287, 288, 291, 293, 651, 653

(56) References Cited

U.S. PATENT DOCUMENTS

| | | | | |
|---|---|---|---|---|
| D. 307,046 | * | 4/1990 | Burgess et al. | 4/651 |
| 346,579 | * | 8/1886 | Butler | 4/287 |
| 438,465 | * | 10/1890 | Blessing | 4/287 |
| 655,888 | * | 8/1900 | O'Neil | 4/651 |
| 1,035,457 | * | 8/1912 | Madden | 4/651 |
| 2,374,642 | * | 5/1945 | Bloch | 4/687 |
| 2,671,909 | * | 3/1954 | Santarsiero | 4/287 |
| 2,761,626 | * | 9/1956 | Gustaveson | 4/679 |
| 2,817,098 | * | 12/1957 | Mustee | 4/651 |
| 2,891,574 | * | 6/1959 | Dahlberg | 4/679 |
| 4,128,905 | * | 12/1978 | Mathes | 4/287 |
| 4,205,710 | * | 6/1980 | Dunicz | 4/679 |
| 4,698,861 | * | 10/1987 | Bogusz | 4/286 |

FOREIGN PATENT DOCUMENTS

| | | | | |
|---|---|---|---|---|
| 712598 | * | 7/1954 | (GB) | 4/687 |
| 576265 | * | 4/1958 | (IT) | 4/287 |
| 7707-362 | * | 10/1978 | (NL) | 4/679 |

* cited by examiner

*Primary Examiner*—Charles R. Eloshway

(57) ABSTRACT

A sink drain extension for allowing the use of the drain or for a connected disposal to disperse water or other liquids and solid waste material when the sink within which the disposal and drain are disposed is filled with a usable quantity of water or other liquid without commingling the waste material with the usable water or other liquid. The extension is formed from an upstanding hollow member having one end engaging the sink drain and a second free end. A stabilizing member connects with the drain engaging end of the hollow member to secure that end and the hollow member in a substantially fixed position with the drain and prevent relative movement between the hollow member and the sink drain. Appropriate supporting elements are used to seal the drain opening with respect to the extension and to further restrain the tubular member from movement. A strainer may be employed with the extension, and an alternative location for the extension may be utilized along the sink periphery.

4 Claims, 10 Drawing Sheets

SINK DRAIN EXTENSION

BACKGROUND OF THE INVENTION

1. Field of the Invention

The present invention relates to sink drains and more particularly to an apparatus for utilizing the sink drain and, if present, the connected disposal, for the disposal of waste while a quantity of usable water or other liquid is contemporaneously contained in the sink.

2. Description of the Prior Art

Various kinds of sink drainer assemblies are well known and are usually associated with the operation of a disposal into which waste is transferred through the sink drain. Various features associated with sink drains are known to prevent debris carried by dispensed fluid from clogging or jamming the faucet assembly, and devices of this type are shown, for example, in U.S. Pat. Nos. 5,369,815; 5,377,362; and 5,398,720.

When a disposal is involved so that there is not normally a concern of separating a liquid from solid debris as is the case with disposalless sinks, the mixture of fluid and solid waste flows through the sink drain and into the disposal for treatment. In that operation, it is not possible to use the sink in any other manner except for the disposal of waste through the drain and disposal while that operation is ongoing. Thus the sink is otherwise immobilized for any other use unless a separate isolated section of the sink or a second portioned sink is available. Even in this case, a sink normally carries only one disposal so that the isolated sink portion has to be carefully used to assure that no solid debris is passed into the drain which has no disposal.

In many instances and for many reasons, there is often a desire to utilize the sink in some other manner even when the disposal is needed. Unfortunately, the conventional procedure requires first the use of the disposal utilizing the entire sink and next utilizing the entire sink without the disposal for whatever other use is needed.

From the foregoing, it can be seen that there is a need for the ability to utilize a disposal equipped sink in more than one way simultaneously, and it is to that need that the present invention is directed.

BRIEF SUMMARY AND OBJECTIVES OF THE INVENTION

The invention is a sink drain extension for introducing food and solid debris into the sink drain while the sink retains a usable quantity of water or other liquid without the introduced debris engaging and spoiling the retained usable water or other liquid. The extension includes an upstanding substantial hollow member having a first sink drain engaging end and a second free end, the first sink drain engaging end having first and second perimeter edges to cooperatively engage a stabilizing member having first and second cooperatively receiving openings. The stabilizing member fixes the hollow member and prevents relative movement between the hollow member and the sink drain in a sealable fashion. The hollow member can be of a height less than the depth of the sink so that water overflow is prevented in the event sink water flow is overlooked. Appropriate sealing and securing elements are applied to make certain that a sealed drain occurs and that the hollow member is secured so as to prevent relative movement between the member and the sink drain.

To aid in the disposal of solid and fluid debris, the free end of the hollow member can be flared outwardly so that introduction of waste into the hollow member is easily permitted.

The extension may be located along the periphery of the sink and away from the regular sink drain and connected to the drain under the sink thus freeing the sink and regular drain for independent use.

From the forgoing, it is apparent that a primary objective of the present invention is to develop an apparatus for utilizing a sink and the sink drain simultaneously to make the use of these fixtures more efficiently.

Another objective of the present invention is to develop a device of the type described that is simple in operation, uncomplicated in design and construction, and relatively inexpensive.

A further objective of the present invention is to provide a device of the type described which can be utilized on existing sinks without any modification or which can be provided as an accessory to a new sink to be installed.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In that respect, before explaining at least on embodiment of the invention in detail, it is to be understood that the invention is not limited in its arrangement of the components set forth in the following description and illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development. It is important that the claims be regarded as including such equivalent methods and products resulting therefrom that do not depart from the spirit and scope of the present invention. The application is neither intended to define the invention of the application, which is measured by its claims, nor to limit its scope in any way.

Thus, the objects of the invention set forth above, along with the various features of novelty which characterize the invention, are noted with particularity in the claims annexed to and forming a part of this disclosure. For a better understanding of the invention, its operating advantages and the specific results obtained by its use, reference should be made to the following detailed specification taken in conjunction with the accompanying drawings wherein like characters of reference designate like parts throughout the several views.

DETAILED DESCRIPTION OF THE PREFERRED EMBODIMENT

The preferred and alternative embodiments illustrated are not intended to be exhaustive or to limit the invention to the precise form disclosed. The embodiments were chosen and described in order to best explain the principles of the invention and its application and practical use to thereby enable others skilled in the art to best utilize the invention. Other alternative embodiments will also be described.

Figure 1:
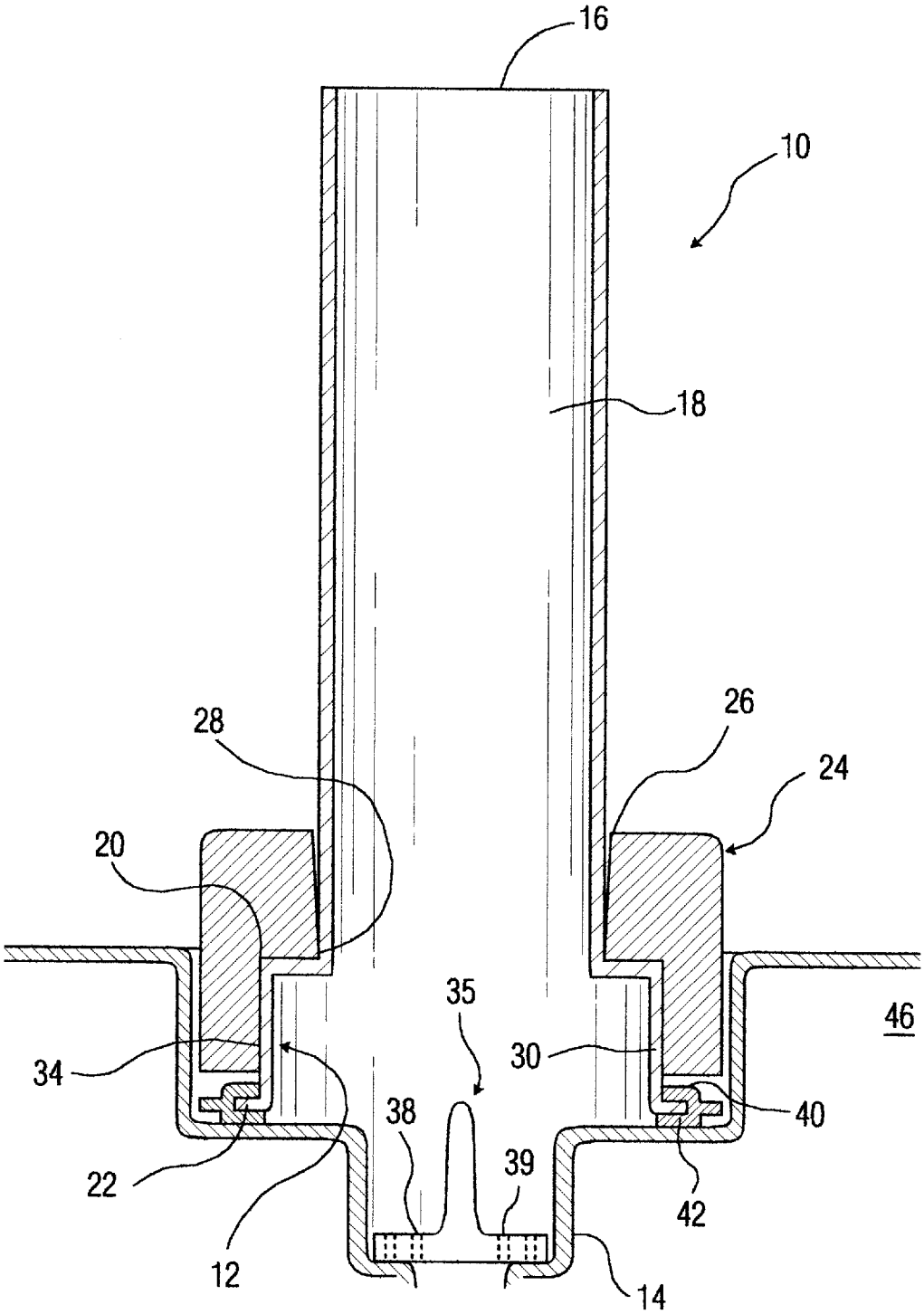
FIG. 1 is a side elevational sectional view of the upstanding tubular member cooperatively received by the stabilizing member communicating with the drain of a sink.

Referring now to the drawings and particularly to FIG. 1, an upstanding hollow member shown generally as 10 has a first end 12 which engages and communicates with the sink drain 14. A second end 16 is open and free so that a non-obstructive passageway 18 is created through member lo and directly into drain 14. First and second perimeter edges 20, 22 are formed in first end 12 and will be described in greater detail subsequently.

Figure 2:
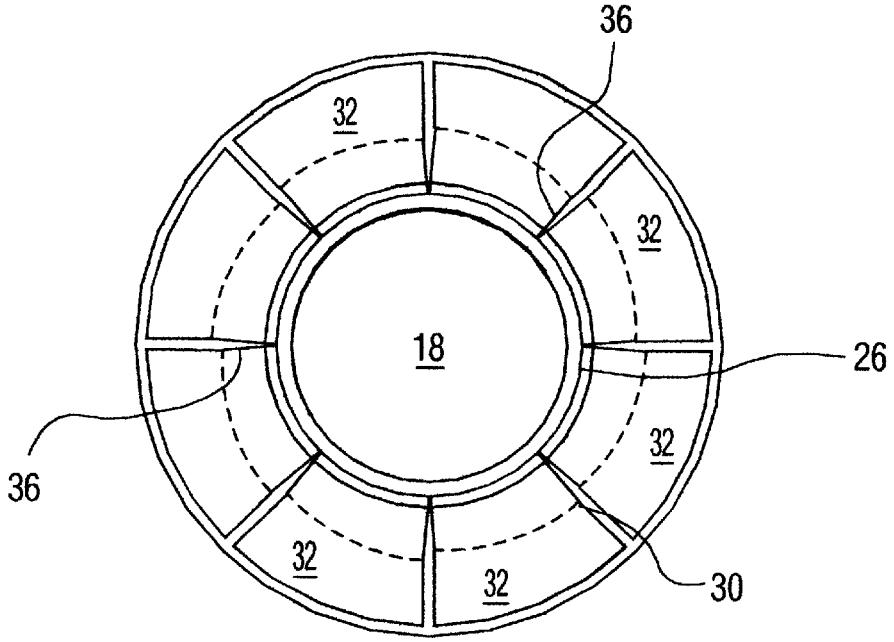
FIG. 2 is bottom plan view of the stabilizing member shown in FIG. 1.
Figure 2A:
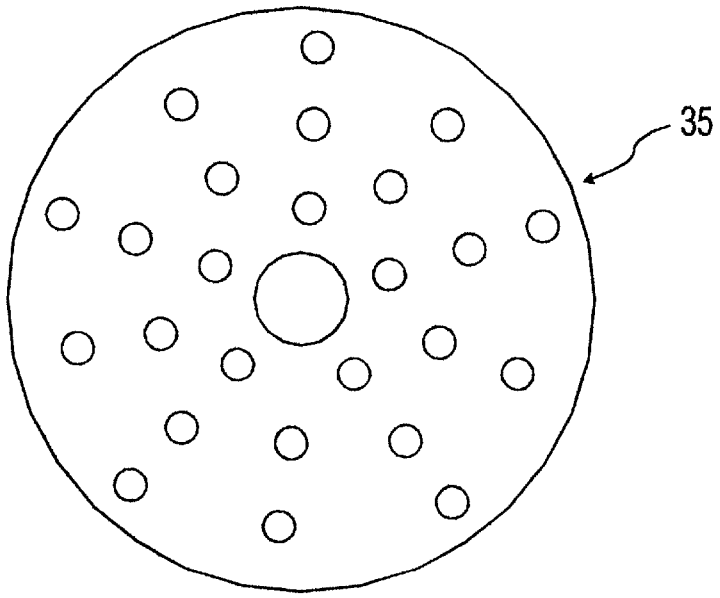
FIG. 2*a* is a top plan view of a strainer that may be used with the tubular and stabilizing member shown in FIGS. 1 and 2.
Figure 3:
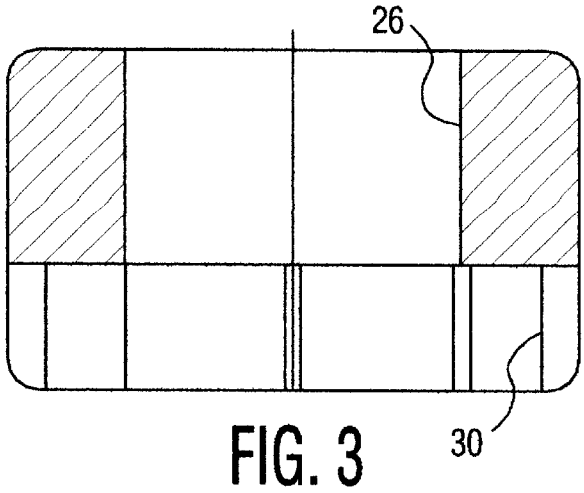
FIG. 3 is a side elevational, sectional view of the stabilizing member shown in FIGS. 1 and 2.
Figure 4:
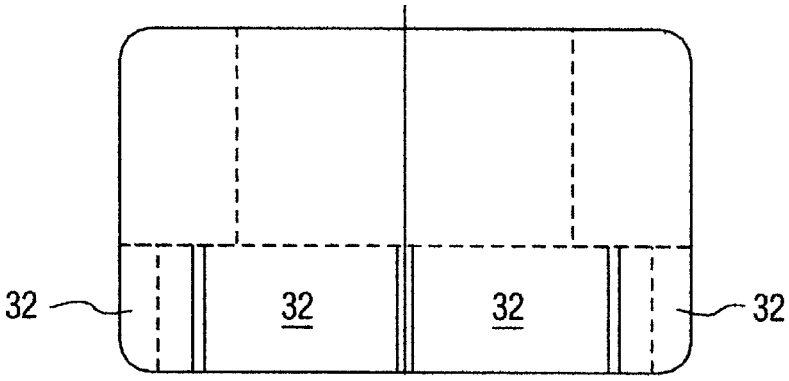
FIG. 4 is a side elevational view of the stabilizing member.
Figure 5:
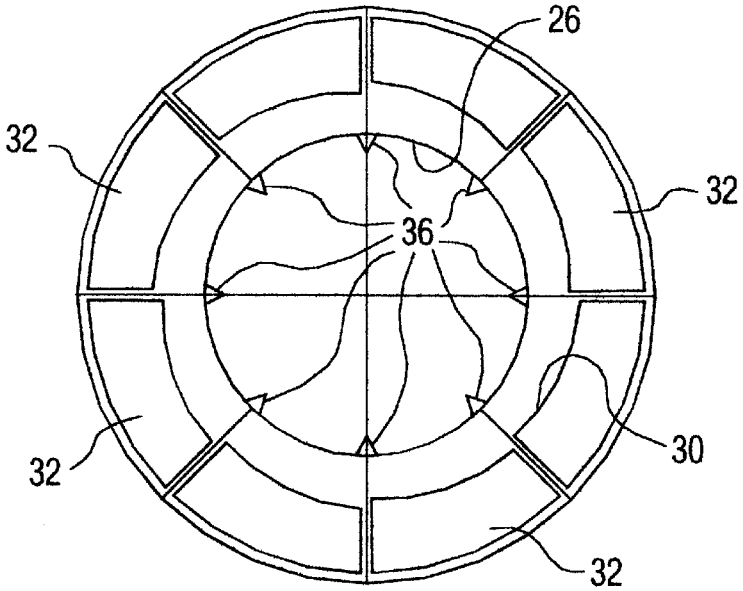
FIG. 5 is a bottom plan view of the stabilizing member.

A stabilizing member 24 generally encircles end 12 and the connecting part of hollow member 10 in the manner shown in FIGS. 1 and 2. Stabilizer 24 has an upper first circular opening 26 cooperatively receiving lower portion 28 of hollow member lo and a second lower opening 30 cooperatively receiving the hollow member first end first perimeter edge 20. First cylindrical opening 26 may be of any convenient form with a preferred construction like that shown in FIG. 2. Second circular opening is formed by a plurality of segments 32 molded and shaped to resiliently engage the outer surface 34 of hollow member end 12 each of which are provided with a hollow member engaging element 36 which grips the outer surface of first circular opening 26 as best shown in FIG. 2.

Figure 6:
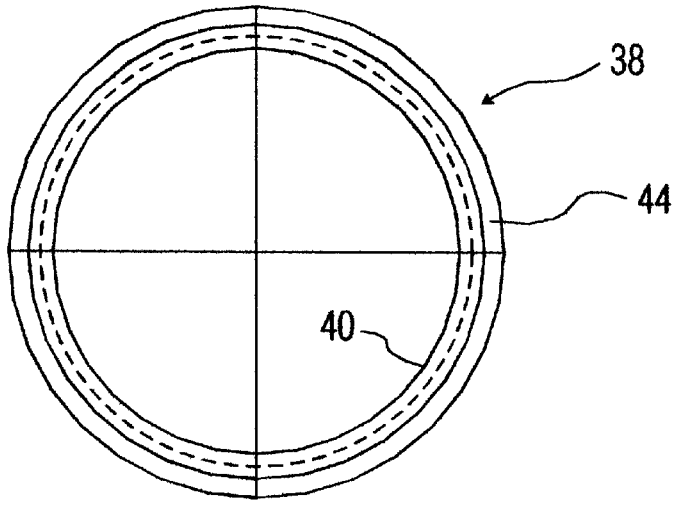
FIG. 6 is a top plan view of the sealing gasket utilized to seal the drain and communicating member.
Figure 7:
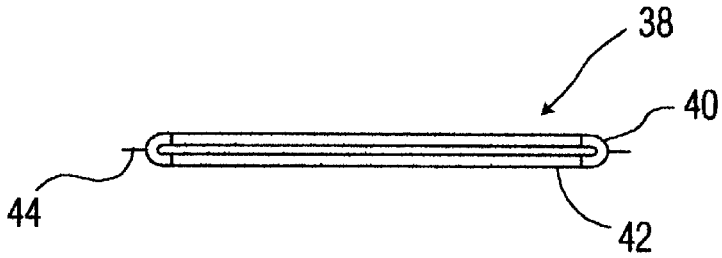
FIG. 7 is a side elevational view of the gasket shown in FIG. 6.
Figure 7A:
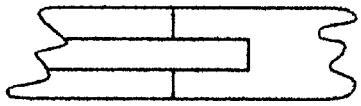
FIG. 7*a* is another embodiment of the gasket shown in FIG. 7.

A sealing element shown generally as 38 (FIGS. 6 and 7) engages second perimeter edge 22 in the manner shown in FIG. 1. Gasket 38 has upper and lower portions 40, 42 which grip second perimeter edge 22 to hold gasket 38 in place, and an extending oppositely directed tab 44 that cooperatively functions with upper and lower portions, 40, 42 to form a seal at drain 14 with first end 12 of hollow member 10.

Thus hollow member 10 is held securely in position over drain 14 by stabilizing member 24, the lower portion of which forms the first circular opening extended downwardly between end 12 and sink structure 46 to tightly fix end 12 of member 10 in position and to enable gasket 38 to form an appropriate seal. Thus stabilizing member 24 connects with drain engaging first end 12 of hollow member 10 to secure end 12 with hollow member 10 in a substantially fixed position with drain 14 and prevent relative movement therebetween. Engaging elements 36 secure member 10 within circular opening 26. The sink drain extension formed by member 10 and stabilizer 24 functions to permit the introduction of food and solid debris into the sink drain or disposal while maintaining the sink in an otherwise usable condition by enabling the retention of a usable unaltered quantity of water. Thus a separate and perhaps more precise washing activity can take place in the sink while the disposal is being used to receive and move away fluid and solid debris simultaneously.

A removable strainer 35 can be positioned within drain 14 which is configured with shoulders 37 to thus retain some solid debris within the sink trap while allowing fluid and finer debris to pass through openings 39 positioned therein. Strainer 35 can be removed by merely lifting upwardly and out of drain 14 when desired.

The height of tube 10 can be slightly less than the height of the sink well so that the inadvertent introduction of a large quantity of water into the sink will overflow end 16 of member 10 and pass through chamber 18 into drain 4 without overflowing the sink. Additionally, the sink drain extension can be removed by gripping member 10 and urging it upwardly without immersing the operator's hand into the retained water.

Hollow member 10 can be of any suitable material and can be circular, funnel-shaped, oval, or any other shape in cross-section. It can be rigid or flexible and may be formed from plastic, metal or other appropriate materials that will withstand a constant exposure to water. It can be straight or angled.

Stabilizer 24 can be formed of any resilient moldable material having sufficient strength and durability to perform the gripping action needed to maintain member 10 in proper sealed position.

Figure 8:
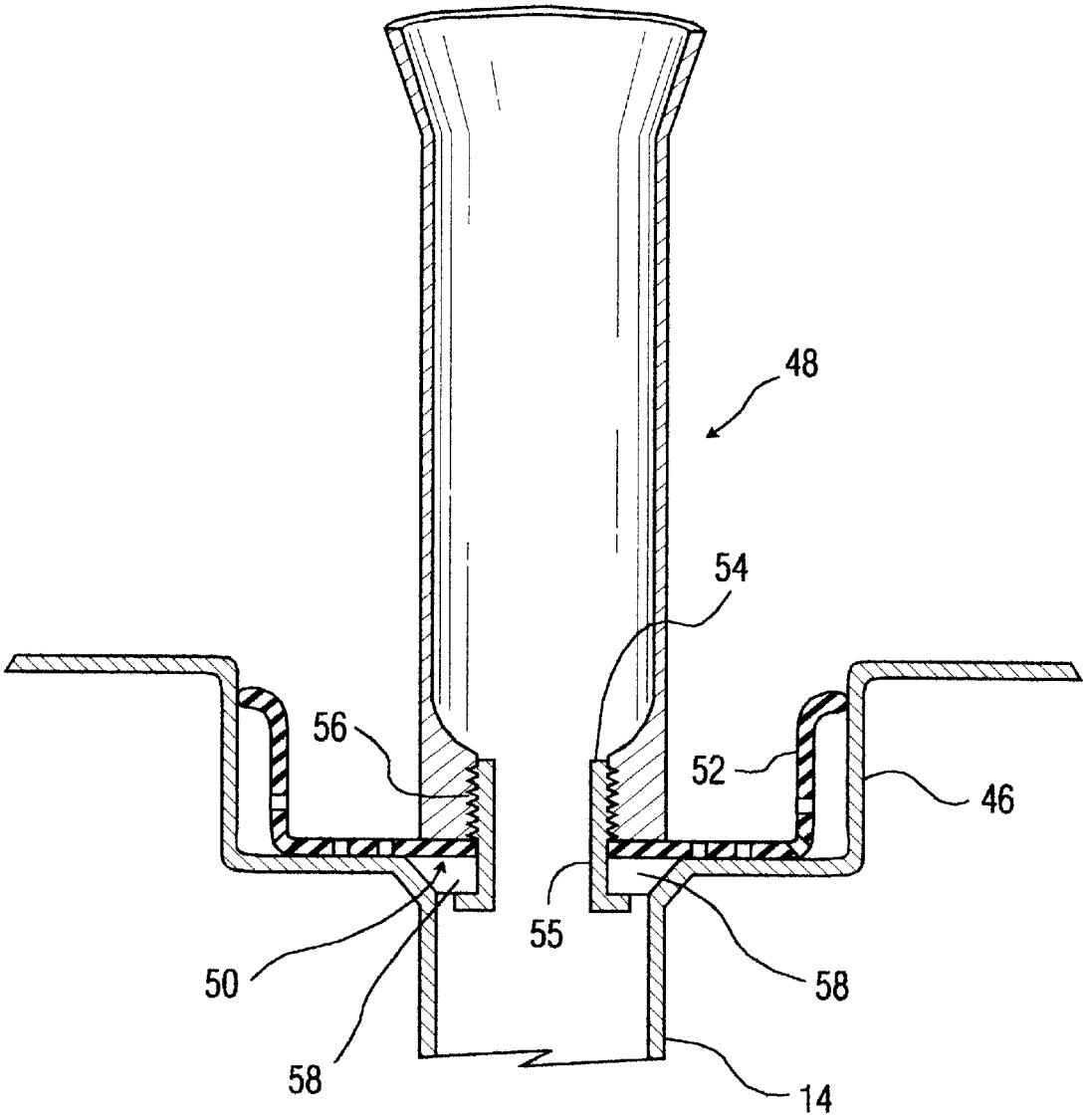
FIG. 8 is a side elevational sectional and perspective view of another embodiment of the upstanding tubular member and a cooperating stabilizing member for communication with the drain of the sink.

In an alternative embodiment shown in FIG. 8, an upstanding hollow member shown generally as 48 communicates with a stabilizing assembly shown generally as 50, the base 52 of which sits in drain 14 to provide a seal therefor. Member 48 is threaded along first end 54 so that it can be rotated on threads 56 provided in member 55 to move holding gasket 58 outwardly thus engaging the interior of drain 14 and holding upstanding member 48 and drain assembly 50 firmly in place.

Figure 9:
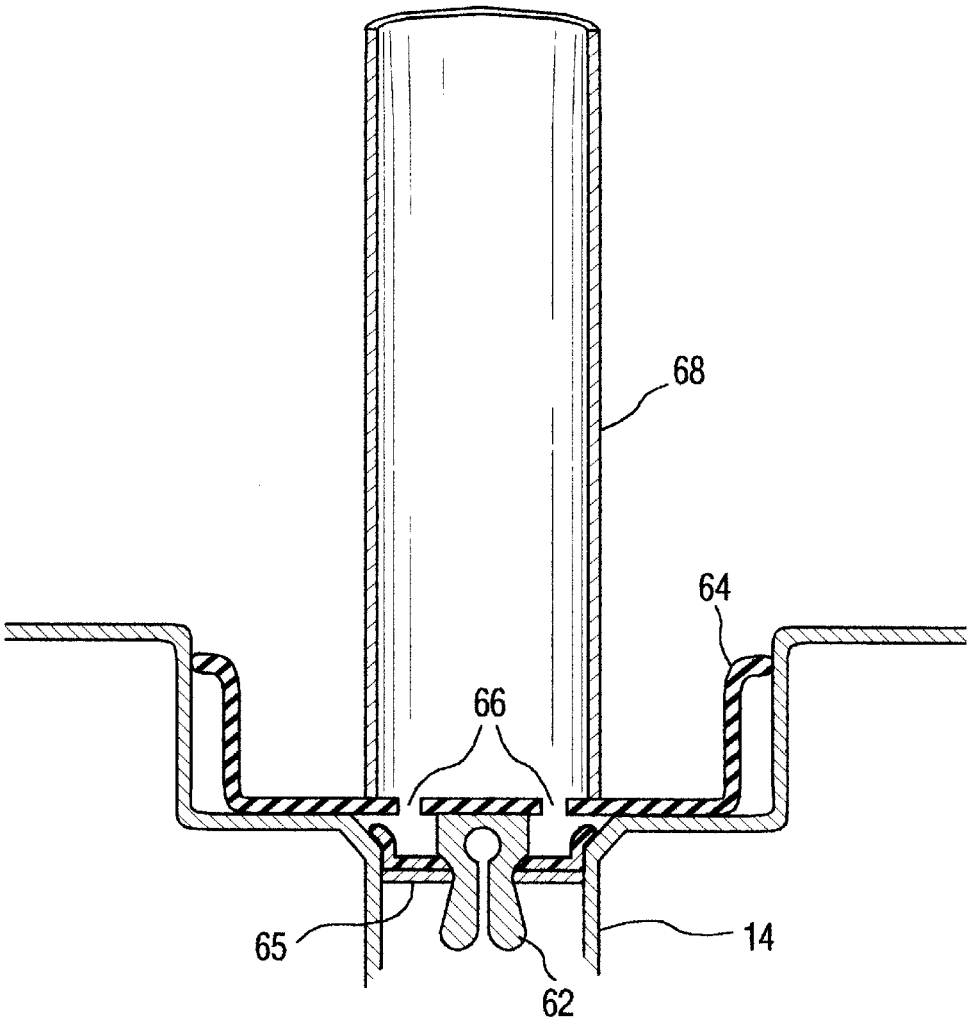
FIG. 9 is a side elevational sectional and perspective view of another embodiment of the upstanding tubular member and a cooperating stabilizing member for communication with the drain of the sink.
Figure 9A:
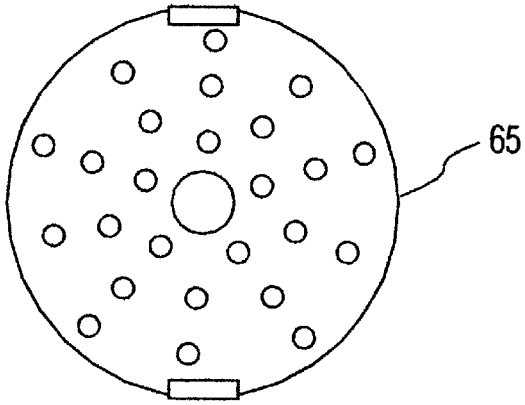
FIG. 9*a* is a top plan view of a strainer that may be used with the embodiment shown in FIG. 9.

Another embodiment is illustrated in FIG. 9 wherein a tubular member 68 secured to a sink drain insert 64 is mounted within drain 14 in a position to cooperatively receive gripping elements 62 mounted to insert 64 that sits within drain 14. A plurality of apertures 66 permits fluid and solid waste to pass on to the disposal or drain, and upstanding member 68 is held firmly in position with respect to member 64 by the tension of gripping elements 62 as they are squeezed inwardly to fit within the interior of tubular member 69. A strainer 65 may be utilized if desired.

Figure 10:
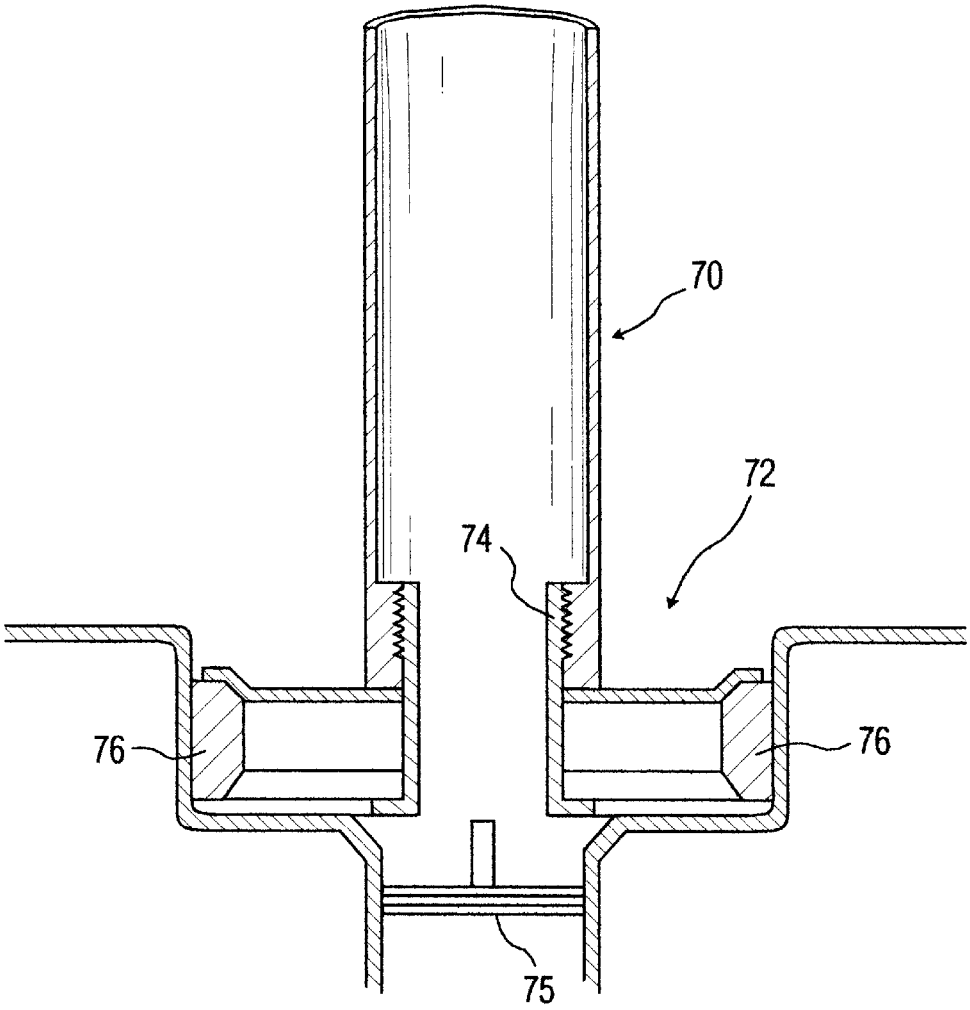
FIG. 10 is a side elevational sectional and perspective view of another embodiment of the upstanding tubular member and a cooperating stabilizing member for communication with the drain of the sink.
Figure 10A:
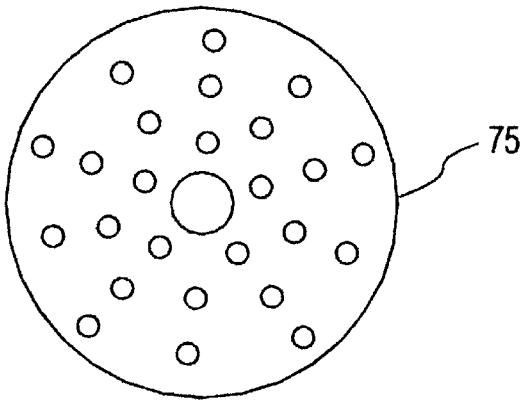
FIG. 10*a* is a top plan view of a strainer that may be used with the embodiment shown in FIG. 10.

Yet another embodiment of the present invention is shown in FIG. 10 with an upstanding member 70 threadably mounted on a stabilizing assembly 72 having spreadable components moved as a result of the threaded connection 74 actuated when upstanding member 70 is rotated. Gripping members 76 move outwardly to grip the interior of the sink drain and hold the upstanding member 70 and stabilizing assembly 72 in a substantially rigid position. Again, a strainer 75 may be utilized if desired.

Figure 11:
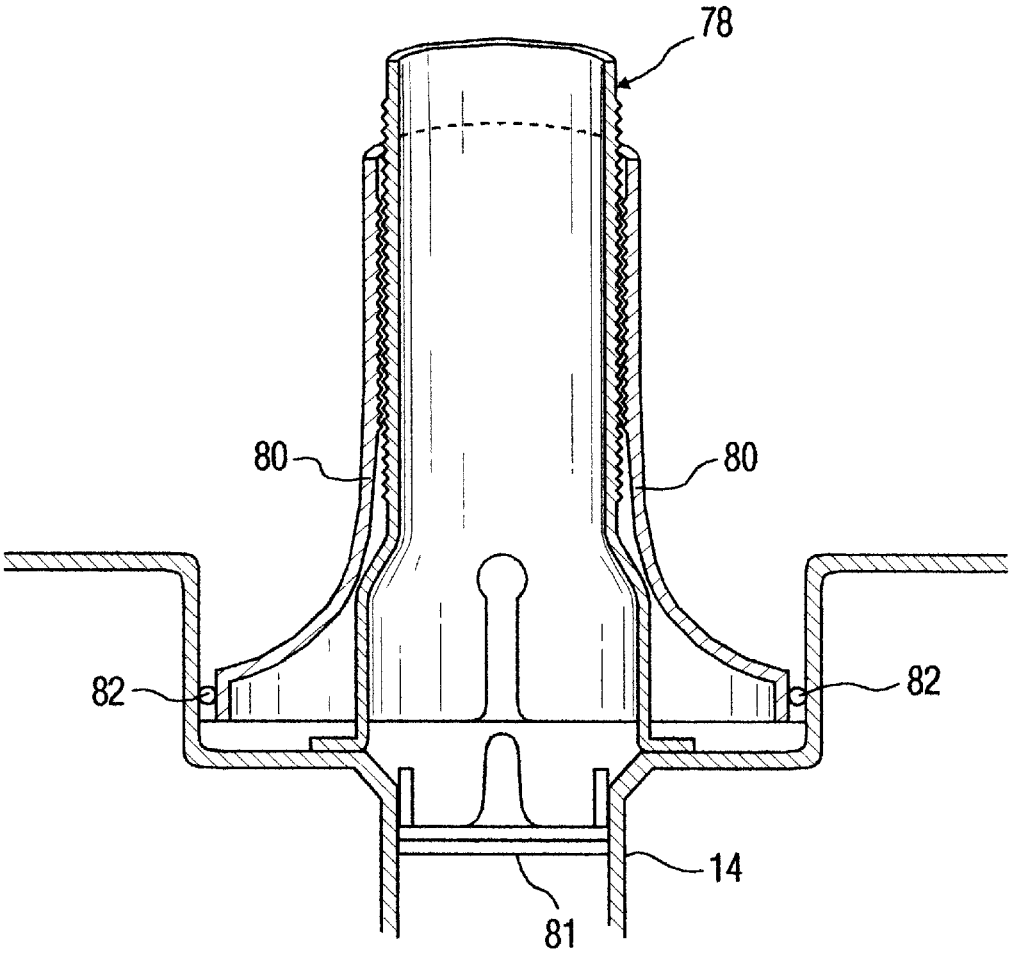
FIG. 11: is a side elevational sectional and perspective view of another embodiment of the upstanding tubular member and a cooperating stabilizing member for communication with the drain of the sink.
Figure 11A:
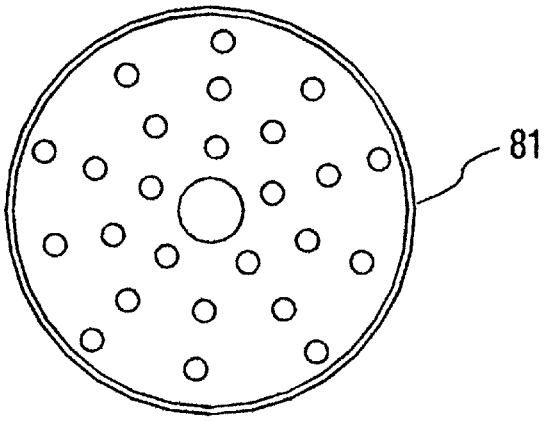
FIG. 11*a* is a top plan view of a strainer that may be used with the embodiment shown in FIG. 11.

Still another embodiment of the present invention is illustrated in FIG. 11 wherein an upstanding member 78 is threadably mated with extendable elements 80 carrying gripping elements 82 that move outwardly against the interior of drain 14 when upstanding member 78 is rotated to hold upstanding member 78 and the stabilizing assembly made up of elements 80 and 82 firmly in place. A strainer 81 may also be utilized.

Figure 12:
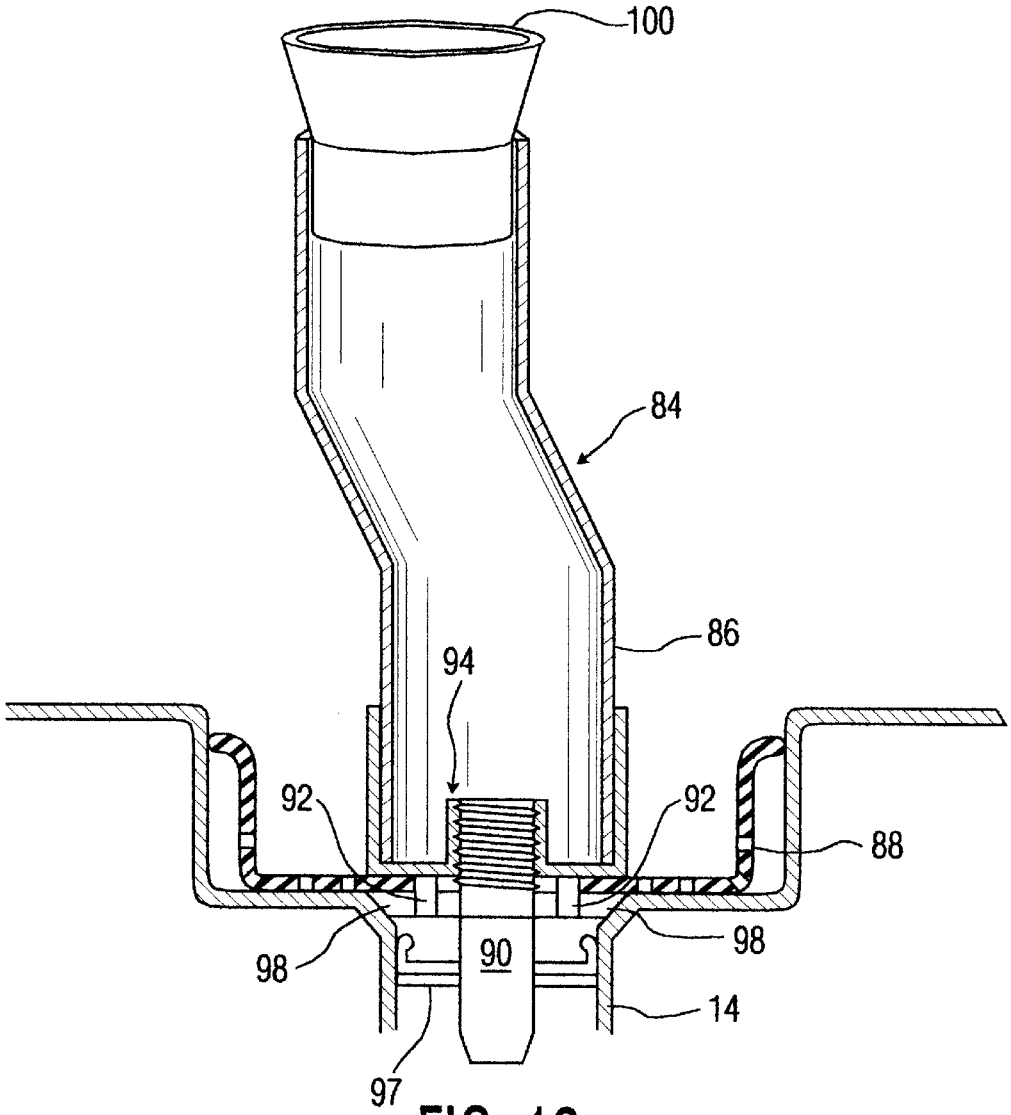
FIG. 12 is a side elevational sectional and perspective view of another embodiment of the upstanding tubular member and a cooperating stabilizing member for communication with the drain of the sink.
Figure 12A:
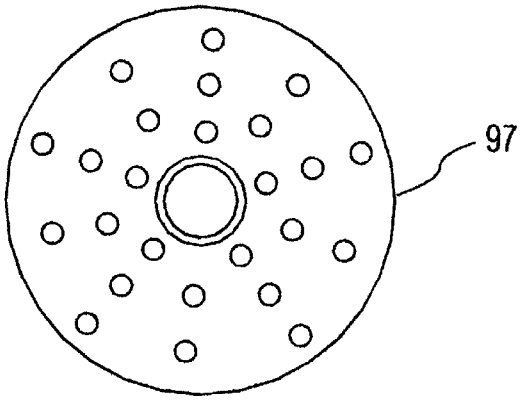
FIG. 12*a* is a top plan view of a strainer that may be used with the embodiment shown in FIG. 12.

A further embodiment of the present invention is illustrated in FIG. 12 wherein an upstanding offset member 84 whose first end 86 communicates with a sink drain insert 88 is threadably received by a threaded member go which is held rigidly within the interior of the sink drain. Apertures 92 connect the interior of sink drain insert 88 with the sink drain for the passage of fluid and solid waste, and the threaded connection shown generally as 94 between a segment 96 affixed to insert 88 and threaded member 90. Threaded connection 94 is inclined so that rotating upstanding offset upstanding member 84 with respect to segment 96 will cause gripping members 96, 98 to move outwardly and engage the interior of drain 14. An optimal strainer 97 is shown in FIGS. 12 and 12*a*.

In the embodiment shown in FIG. 12, the second free end 100 of member 84 is flared so that the disposal of liquid through member 84 while the sink is being used for other matters in a sealed condition is easier. Obviously flared end 100 of FIG. 12 can be utilized in all of the other embodiments of the present invention and any others arising therefrom.

Figure 13:
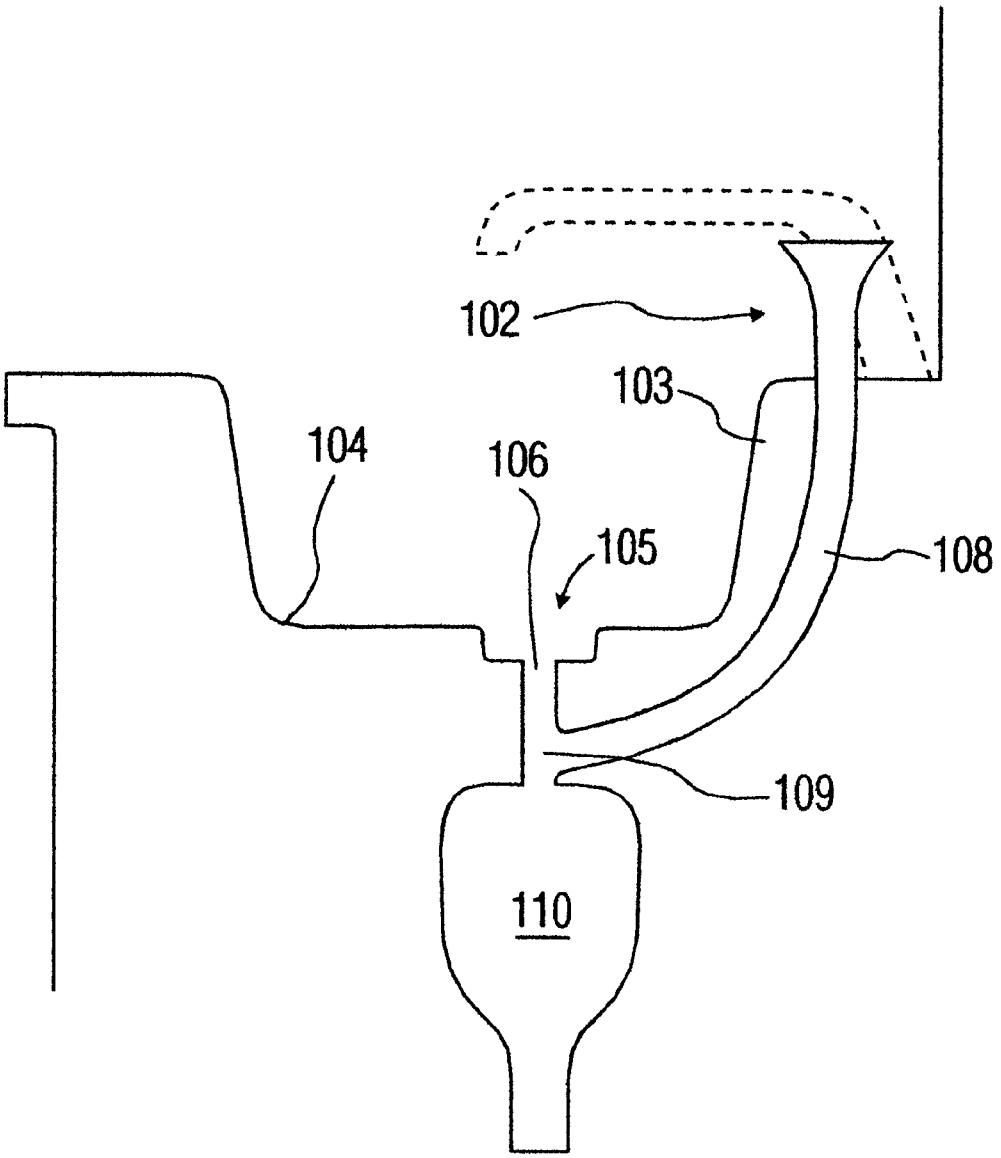
FIG. 13 is a side elevational schematic view of another embodiment of the upstanding tubular member positioned along the periphery of the sink and connecting beneath the sink with the drain.

One additional embodiment of the present invention for a sink drain extension is shown in FIG. 13 wherein an upstanding hollow member 102 is positioned within the periphery 103 of sink 104 rather than directly within the drain 105 of the sink through the open portion 106 of drain 105 within sink 104. A lower connecting hollow member 108 communicates with the upstanding and exposed hollow member 102 along the periphery 103 of the sink down to an intersecting location log with the lower part of the drain underneath the bottom 107 of sink 104 and just prior to the engagement of a disposal 110. Thus, the sink drain extension can be utilized simultaneously with the sink in a manner similar to the other embodiments extending directly into the sink drain opening of the sink.

With respect to the present inventive concept and the embodiments described, it is to be realized and has been shown that the techniques involved in providing the drain extension set forth herein and the components associated therewith are numerous. All equivalent relationships to those illustrated in the drawings and described in the specification are intended to be encompassed herein. The following is considered as illustrative only of the principles of the invention. Since numerous modifications and changes will readily occur to those skilled in the art, there is no intention to limit the invention to the exact construction and operation shown and described. All suitable modifications and equivalents that fall within the scope of the appended claims are deemed within the present inventive concept.

What is claimed is:

1. A sink drain extension for introducing substances into the sink drain while the sink retains a usable quantity of water comprising: an upstanding substantially hollow member having a first sink drain engaging end and a second free end, the first sink drain engaging end having first and second perimeter edges; a stabilizing member cooperatively associated with the substantially hollow member first sink drain engaging end to retain the hollow member in a substantially fixed position; and sealing means cooperatively and releasably secured to at least one of the first sink drain engaging end perimeter edges, wherein the stabilizing member secures the hollow member and prevents relative movement between the hollow member and the sink drain, the sealing means is a circular gasket, and the stabilizing member securing means includes a plurality of hollow member engaging elements.

2. A sink drain extension for introducing substances into the sink drain while the sink retains a usable quantity of water comprising: a hollow member having a first sink drain engaging end and a second free end, the first sink drain engaging end having first and second perimeter edges; and a stabilizing member cooperatively associated with the hollow member first sink drain engaging end to retain the hollow member in a substantially fixed position wherein the stabilizing member has means to secure the hollow member and prevent relative movement between the hollow member and the sink drain and the stabilizing member securing means includes a plurality of hollow member engaging elements.

3. A sink drain extension for introducing fluid and waste materials in to the sink drain while the sink retains a usable quantity of water without the introduced fluid and waste materials engaging the retained usable water, the extension comprising: a hollow tubular member having a first sink drain engaging end and a second free end, the first sink drain engaging end having first and second perimeter edges; a stabilizing member cooperatively associated with and contiguously engaging the hollow tubular member at the first sink drain engaging end to retain the hollow member in a substantially fixed position; and sealing means cooperatively and releasably secured to at least one of the first sink drain engaging end perimeter edges, the stabilizing member including one or more hollow member engaging elements to engage the hollow member and prevent relative movement between the hollow member and the sink drain.

4. The extension as claimed in claim 3 wherein the stabilizing member engages the first sink drain engaging end perimeter edge, the hollow member second free end is flared and the sealing means is a circular gasket.

* * * * *